US008928214B2

(12) United States Patent
Saji et al.

(10) Patent No.: US 8,928,214 B2
(45) Date of Patent: Jan. 6, 2015

(54) IGNITION PLUG

(71) Applicant: NGK Spark Plug Co., Ltd., Nagoya (JP)

(72) Inventors: Toshimasa Saji, Konan (JP); Hirokazu Kurono, Nagoya (JP); Toshitaka Honda, Nagoya (JP)

(73) Assignee: NGK Spark Plug Co., Ltd., Aichi-ken (JP)

( * ) Notice: Subject to any disclaimer, the term of this patent is extended or adjusted under 35 U.S.C. 154(b) by 0 days.

(21) Appl. No.: 14/042,836

(22) Filed: Oct. 1, 2013

(65) Prior Publication Data

US 2014/0091707 A1 Apr. 3, 2014

(30) Foreign Application Priority Data

Oct. 1, 2012 (JP) ..... 2012-219094
Sep. 25, 2013 (JP) ..... 2013-198834

(51) Int. Cl.
*H01T 13/38* (2006.01)
*H01T 13/20* (2006.01)
*H01T 13/41* (2006.01)

(52) U.S. Cl.
CPC ..... *H01T 13/41* (2013.01); *H01T 13/20* (2013.01); *H01T 13/38* (2013.01)
USPC ..... 313/143; 313/145; 313/137

(58) Field of Classification Search
CPC ..... H01L 13/20–13/39
USPC ..... 313/118–145
See application file for complete search history.

(56) References Cited

U.S. PATENT DOCUMENTS

| | | | | |
|---|---|---|---|---|
| 4,949,006 | A * | 8/1990 | Oshima et al. | 313/144 |
| 5,852,340 | A * | 12/1998 | Ito et al. | 313/141 |
| 5,962,957 | A | 10/1999 | Tanaka et al. | |
| 2007/0188065 | A1 | 8/2007 | Ishinada et al. | |
| 2009/0256461 | A1 * | 10/2009 | Walker, Jr. | 313/137 |
| 2010/0264823 | A1 | 10/2010 | Suzuki et al. | |
| 2013/0264939 | A1 | 10/2013 | Fukushima et al. | |

FOREIGN PATENT DOCUMENTS

| | | | |
|---|---|---|---|
| EP | 0 548 424 | A1 | 6/1993 |
| JP | 5-54954 | A | 3/1993 |
| JP | 9-266055 | A | 10/1997 |
| JP | 2006-236906 | A | 9/2006 |
| JP | 2007-242588 | A | 9/2007 |
| JP | 2009-245716 | A | 10/2009 |
| JP | 2012-129132 | A | 7/2012 |

OTHER PUBLICATIONS

Office Action dated Aug. 19, 2014 issued by the Japanese Patent Office in counterpart Japanese Patent Application No. 2013-198834.

* cited by examiner

*Primary Examiner* — Mariceli Santiago
(74) *Attorney, Agent, or Firm* — Sughrue Mion, PLLC

(57) ABSTRACT

An ignition plug, wherein, when a relative density of a portion of an insulator, which is positioned between a radial virtual plane including a front end of the insulator and a radial virtual plane including a front end of a portion of the insulator which is in contact with a metal shell or the plate packing, is referred to as A (%), and a relative density of a portion of the insulator, which is positioned between the radial virtual plane including the front end of the portion of the insulator which is in contact with the metal shell or the plate packing and a radial virtual plane including a center of a resistor in an axial direction, is referred to as B (%), the following equations are satisfied: $93.90 \leq A$, and $0.10 \leq A-B \leq 0.90$.

4 Claims, 4 Drawing Sheets

IGNITION PLUG

CROSS-REFERENCE TO RELATED APPLICATIONS

This application claims priority from Japanese Patent Application No. 2012-219094 filed on Oct. 1, 2012, and Japanese Patent Application No. 2013-198834 filed on Sep. 25, 2013, the entire contents of which are incorporated herein by reference.

TECHNICAL FIELD

Aspects of the present invention relate to an ignition plug for use in an internal combustion engine or the like.

BACKGROUND

An ignition plug is mounted in an internal combustion engine (an engine) and is used to ignite an air-fuel mixture or the like in a combustion chamber. In general, the ignition plug includes an insulator having an axial hole which extends in an axial direction, a center electrode which is inserted in a front end side of the axial hole, a metal shell which is provided on an outer circumference of the insulator, and a ground electrode which is fixed to a front end portion of the metal shell. In addition, the insulator is fixed to the metal shell in such a state that a step portion provided on an outer circumference of the insulator engages with an inner circumference of the metal shell directly or via a metallic plate packing Then, when the internal combustion engine is in operation, heat received by a front end portion of the insulator is drawn mainly from the step portion towards the metal shell.

Further, a spark discharging gap is defined between a distal end portion of the ground electrode and a front end portion of the center electrode. By applying a high voltage to the spark discharging gap to thereby generate a spark discharge, the air-fuel mixture is ignited (refer to JP-A-2007-242588, for example). Along with this, in order to suppress generation of radio noise in association with the application of the high voltage, a resistor containing metal and glass is provided further rearwards than the center electrode in the axial hole (that is, along an energization path of the spark discharging gap) in a position lying further rearwards than the step portion.

Incidentally, in recent years, in order to cope with the demand for improved fuel economies and regulations to preserve the environment, there have been proposed engines which are highly supercharged and engines with high compression ratios. In these engines, since a relatively high pressure is generated in a combustion chamber, a relatively high voltage is necessary to generate a spark discharge (a spark discharging voltage). If the spark discharging voltage is increased, a spark discharge which penetrates the insulator (a through discharge) is generated in a location lying further forwards towards the front end side than a location where the insulator contacts the metal shell or the plate packing (namely, at a thinner location in particular). Accordingly, a normal spark discharge may be disturbed (an accidental fire is caused).

Taking this into account, it is considered to improve the withstand voltage performance of the insulator by increasing the density (the relative density) of the insulator so as to suppress the generation of the through discharge. Here, in the related-art ignition plug, a relative density of the insulator is uniform in every portion on the insulator.

SUMMARY

However, in the event that the relative density of the insulator is increased even more, the thermal conductivity of the insulator is also increased. Because of this, the heat received by the front end portion of the insulator tends to be transmitted to the resistor by way of a portion of the insulator which is positioned further rearwards towards the rear end side than the step portion. As a result, the deterioration of the metal and glass in the resistor is facilitated, leading to fears that the resistance value of the resistor increases drastically.

In view of the above, the present invention provides an ignition plug which can suppress the increase in resistance value of the resistor effectively while realizing a superior withstand voltage performance.

In a first aspect of the present invention, there is provided an ignition plug including: an insulator having an axial hole which extends in an axial direction; a center electrode which is inserted in a front end side of the axial hole; a metal shell which is provided on an outer circumference of the insulator; and a resistor which is disposed in the axial hole at a position further rearwards than the center electrode, wherein the insulator includes a step portion which engages with the metal shell directly or via an annular plate packing, wherein the resistor is positioned further rearwards in the axial direction than the step portion, wherein, when a relative density of a portion of the insulator, which is positioned between a radial virtual plane including a front end of the insulator and a radial virtual plane including a front end of a portion of the insulator which is in contact with the metal shell or the plate packing, is referred to as A (%), and a relative density of a portion of the insulator, which is positioned between the radial virtual plane including the front end of the portion of the insulator which is in contact with the metal shell or the plate packing and a radial virtual plane including a center of the resistor in the axial direction, is referred to as B (%), the following equations are satisfied:

$$93.90 \leq A, \text{ and } 0.10 \leq A - B \leq 0.90.$$

Here, the "relative density" means a ratio of an actual density of the insulator to a theoretical density of the insulator. The "theoretical density" means a density which is calculated from contents of oxides, which are obtained by expressing the contents of elements contained in the insulator in terms of oxides, based on the mixing rule. The "actual density" means an actual density of the insulator which is measured based on the Archimedian method. In the Archimedian method, a phenomenon is made use of in which a solid in a liquid is given a buoyancy force which is the same as the weight of the liquid which is displaced by the solid. Namely, a volume of an object to be measured is obtained based on a weight of a specimen measured in such a state that the specimen is receiving a buoyancy force in pure water and a weight of the specimen measured in a dry state in the atmosphere, and a density of the object to be measured is calculated based on the obtained volume. In calculating the density, a correction is made based on a change in density by the temperature of the pure water, so as to increase the measuring accuracy.

According to the first aspect, the relative density A (%) of the portion of the insulator which is positioned between the radial virtual plane including the front end of the insulator and the radial virtual plane including the front end of the portion of the insulator which is in contact with the metal shell or the plate packing (namely, the portion of the insulator where the through discharge is particularly generated, which may be hereinafter referred to as a front end portion of the insulator)

is configured so as to satisfy 93.90%≤A. Consequently, it is possible to prevent the generation of through discharge more reliably.

Further, according to the first aspect, the relative density B (%) of the portion of the insulator which is positioned between the radial virtual plane including the front end of the portion of the insulator which is in contact with the metal shell or the plate packing and the radial virtual plane including the center of the resistor in the axial direction (hereinafter may be referred to as a middle portion of the insulator) is configured so as to satisfy 0.10≤A−B. Namely, the relative density B of the middle portion of the insulator is configured so as to be smaller by 0.10% than the relative density A of the front end portion of the insulator. Consequently, the thermal conductivity of the middle portion of the insulator can be made relatively small. As a result, the increase in resistance value of the resistor can be suppressed, thereby making it possible to extend the life of the resistor.

On the other hand, in the event that the relative density difference between the front end portion and the middle portion of the insulator is made too large, when a load is applied to the insulator in a direction which intersects the axial line, stress is concentrated to a boundary portion between the front end portion and the middle portion of the insulator, leading to fears that the insulator is subjected to breakage.

In this regard, according to the first aspect, since A−B≤0.90 is satisfied, it is possible to prevent the concentration of stress to the boundary portion between the front end portion and the middle portion of the insulator more reliably. As a result, it is possible to realize a superior mechanical strength in the insulator.

In a second aspect of the present invention, there is provided the ignition plug according to the first aspect, wherein the following equation is satisfied:

$$0.15 \leq A-B \leq 0.50.$$

According to the second aspect, since 0.15≤A−B is satisfied, the thermal conductivity of the middle portion of the insulator can be made smaller. Consequently, it is possible to restrain heat from being conducted to the resistor further effectively, thereby making it possible to suppress further the increase in resistance value of the resistor.

Further, according to the second aspect, since A−B≤0.50 is satisfied, it is possible to prevent the concentration of stress to the boundary portion between the front end portion and the middle portion of the insulator more reliably, whereby it is possible to improve the mechanical strength of the insulator further.

In a third aspect of the present invention, there is provided the ignition plug according to the first or second aspect, wherein, when a relative density of a portion of the insulator, which is positioned between the radial virtual plane including the center of the resistor in the axial direction and a radial virtual plane including a rear end of the insulator, is referred to as C (%), the following equation is satisfied:

$$C \leq B.$$

In disposing the resistor compound which becomes a resistor after sintering and the center electrode in the axial hole, when the productivity is taken into consideration, it is preferable that the center electrode and the resistor compound are introduced into the interior of the axial hole in such a state that the insulator is supported so that the rear end-side opening of the axial hole faces upwards. Here, in the event that the center of gravity of the insulator is positioned relatively rearwards, when the insulator is supported in the state described above, the insulator tends to be collapsed easily. This may lead to a reduction in productivity.

In this respect, according to the third aspect, the relative density C (%) of the portion of the insulator which is positioned between the radial virtual plane including the center of the resistor and the radial virtual plane including the rear end of the insulator (hereinafter may be referred to as a rear end portion of the insulator) is configured so as to satisfy C≤B. Consequently, since the center of gravity of the insulator can be positioned further forwards, it is possible to prevent the collapse of the insulator reliably. As a result, it is possible to enhance the productivity.

In a fourth aspect of the present invention, there is provided the ignition plug according to any of the first to third aspects, wherein a diameter of a portion of the axial hole in which the resistor is disposed is 2.9 mm or smaller.

According to the fourth aspect, the diameter of the portion of the axial hole in which the resistor is disposed is 2.9 mm or smaller, and therefore, the resistance value of the resistor tends to be increased easily. This is effective to control the thermal conductivity through density as done in the first and second aspects, in particular. It is preferable that the diameter of the portion of the axial hole where the resistor is disposed is constant in the direction of the axial line.

DETAILED DESCRIPTION

Figure 1:
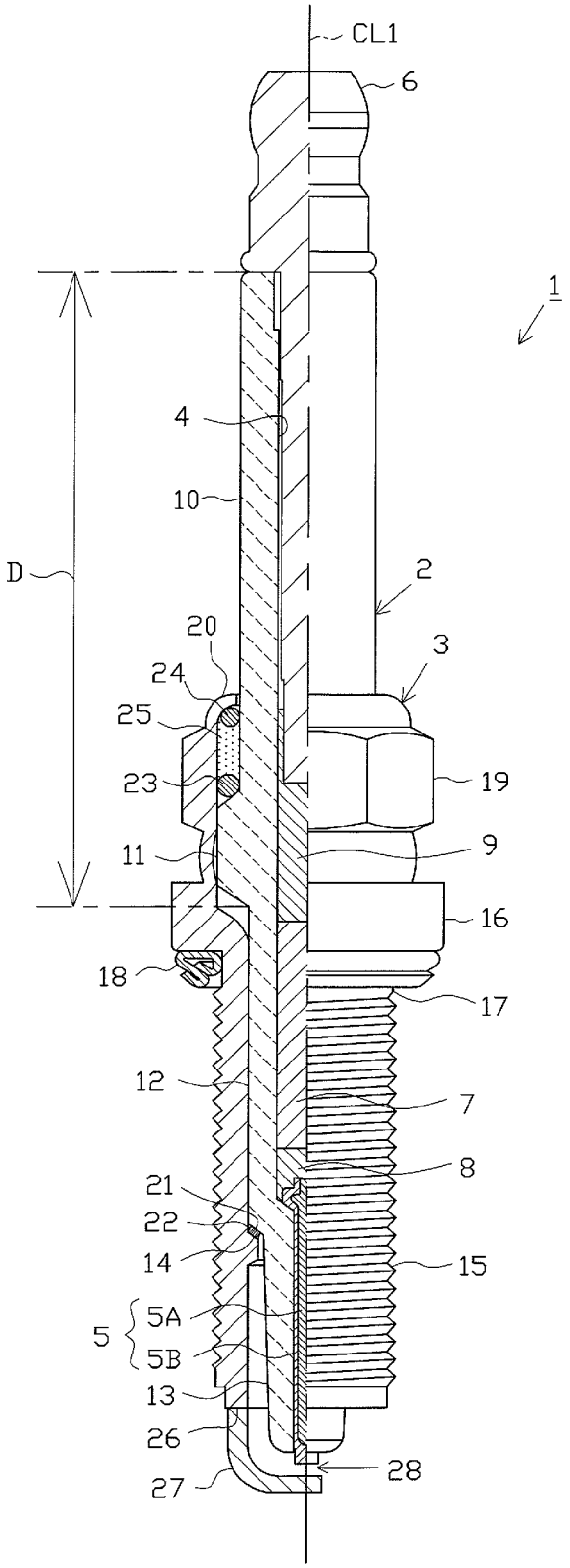
FIG. 1 is a partially cutaway front view showing the configuration of an ignition plug.

Hereinafter, an embodiment of the invention will be described by reference to the drawings. FIG. 1 is a partially cutaway front view showing an ignition plug 1. It is noted that in FIG. 1, the direction of an axial line CL1 of the ignition plug 1 is referred to as a vertical direction in the figure, and a lower side of the figure will be described as a front end side, whereas an upper side of the figure will be described as a rear end side of the ignition plug 1.

The ignition plug 1 includes an insulator 2 which is a cylindrical insulator, a cylindrical metal shell 3 which holds the insulator 2 and the like.

It is known that the insulator 2 is formed by sintering alumina or the like and includes externally a rear end-side body portion 10 which is formed at a rear end side, a large-diameter portion 11 which protrudes most radially outwards in a position lying further forwards towards a front end side than the rear end-side body portion 10, a middle body portion 12 which is formed thinner than the large-diameter portion 11 in a position lying further forwards towards the front end side than the large-diameter portion 11 and a nose portion 13 which is formed thinner than the middle body portion 12 in a position lying further forwards towards the front end side than the middle body portion 12. In addition, in the insulator 2, the large-diameter portion 11, the middle body portion 12 and most of the nose portion 13 are accommodated in an interior of the metal shell 3. Additionally, a tapered step portion 14 is formed at a connecting portion which is provided between the middle body portion 12 and the nose portion 13 so as to continuously connect them. The insulator 2 is engaged with the metal shell 3 at the step portion 14. In addition, an axial hole 4 is formed in the insulator 2 so as to extend along the axial line CL1 to penetrate the insulator 2.

Figure 2:
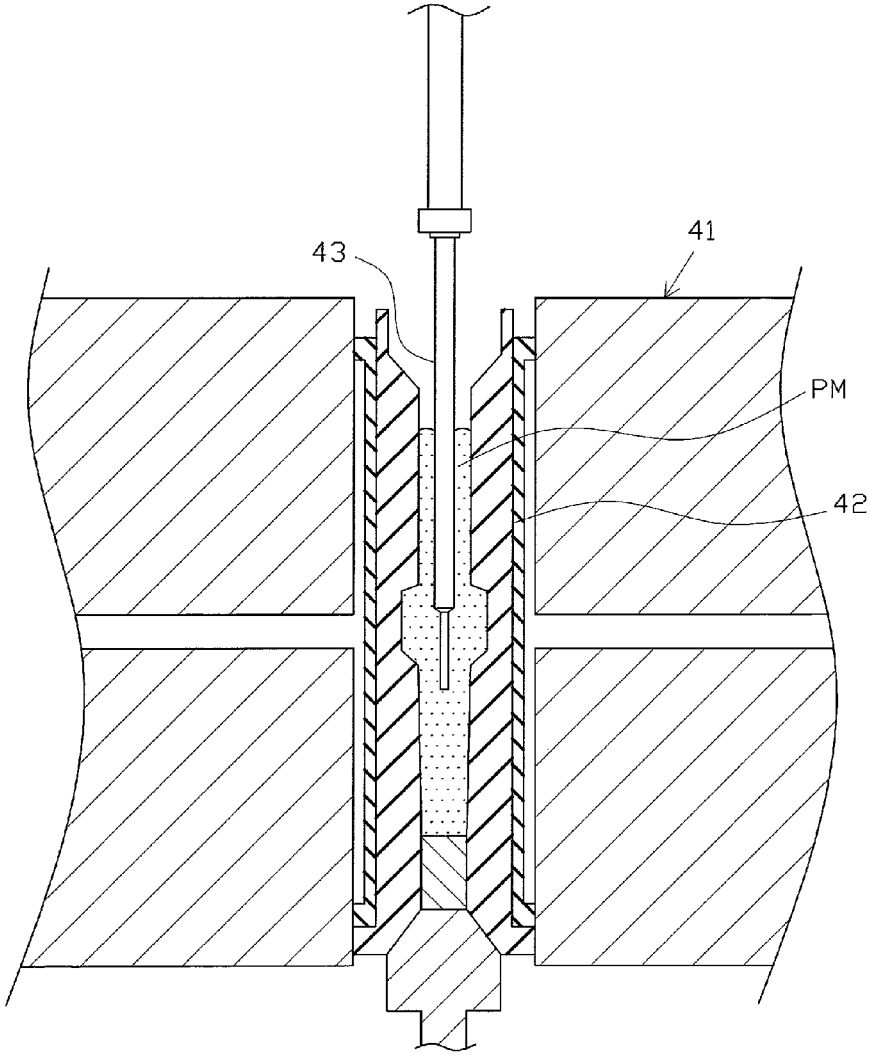
FIG. 2 is a partially cutaway front view showing a rubber press molding machine for use in forming an insulator.

As shown in FIG. 2, the insulator 2 can be formed by employing a rubber press molding machine 41 having a cylindrical rubber mold 42. Specifically, a powder material PM which contains alumina powder as a main constituent is loaded within the rubber mold 42, and a rod-shaped (needle-shaped) press pin 43 is inserted into the rubber mold 42. Then, a force is applied to the powder material PM in a radial direction from the rubber mold 42 so as to compress the powder material PM to thereby mold a molded product from the powder material PM. Thus, the molded product is obtained, and thereafter, the molded product so obtained is shaped on an outer circumference thereof, and the shaped molded product is then sintered, whereby the insulator 2 can be obtained.

Returning to FIG. 1, a center electrode 5 is inserted in the axial hole 4 at a front end side and is then fixed in place thereat. The center electrode 5 includes an inner layer 5A which is made of a metal (for example, copper, a copper alloy, pure nickel (Ni) or the like) which has superior thermal conductivity, and an outer layer 5B which is mainly formed of Ni. In addition, the center electrode 5 has a rod-like shape (a cylindrical shape) as a whole and protrudes from a front end of the insulator 2 at a front end portion thereof Additionally, a terminal electrode 6 is inserted in the axial hole 4 at a rear end side in such a state that the terminal electrode 6 protrudes from a rear end of the insulator 2 and is then fixed in place thereat.

Further a cylindrical resistor 7 is disposed in the axial hole 4 in a position lying further rearwards than the center electrode 5. This resistor 7 has a resistance value which is equal to or larger than a predetermined value (for example, 100Ω) so as to suppress radio noise and is formed by heating and sealing a resistor compound which is made up of a conductive material (for example, carbon black or the like), glass and the like into a required shape. The resistor 7 is electrically connected to the center electrode 5 and the terminal electrode 6 via conductive glass seal layers 8, 9, respectively, at both end portions thereof. The resistor 7 is positioned further rearwards in the direction of the axial line CL1 than a step portion 21, which will be described later. The resistor 7 is formed by supporting the insulator 2 at the large-diameter portion 11 with a predetermined supporting jig (not shown) so that a rear end-side opening of the axial hole 4 faces upwards, disposing the center electrode 5 and the resistor compound in the axial hole 4 from the rear end-side opening thereof and thereafter heating the resistor compound.

In addition, the metal shell 3 is formed of a metal such as low carbon steels or the like into a cylindrical shape, and a thread portion (an external thread portion) 15 is formed in an outer circumferential surface of the metal shell 3 so that the ignition plug 1 is mounted in a combustion apparatus such as an internal combustion engine, a fuel cell reformer or the like thereat. Additionally, a seat portion 16 is formed so as to protrude radially outwards in a position lying further rearwards towards the rear end side than the thread portion 15, and a ring-shaped gasket 18 is fitted in a thread neck 17 at a rear end of the thread portion 15. Further, a tool engagement portion 19 having a hexagonal cross section is provided at a rear end side of the metal shell 3 so that a tool such as a wrench or the like is brought into engagement therewith in mounting the metal shell 3 in the combustion apparatus. Additionally, a crimped portion 20 is provided at a rear end portion of the metal shell 3 so as to be bent radially inwards.

Further, the step or projecting portion 12 is provided on an inner circumferential surface of the metal shell 3 so that the insulator 2 is engaged thereat. The insulator 2 is inserted into the metal shell 3 from the rear end side towards a front end side and is fixed to the metal shell 3 by crimping a rear end-side opening portion of the metal shell 3 radially inwards, that is, by forming the crimped portion 20 in such a state that the step portion 14 of the insulator 2 is engaged with the projecting portion 12 via an annular plate packing 22 which is made of a predetermined metal. It is noted that interposing the plate packing 22 between the step portion 14 and the projecting portion 12 holds the gastightness within a combustion chamber so as to prevent the leakage of a fuel gas which enters a gap between the nose portion 13 of the insulator 2 and the inner circumferential surface of the metal shell 3 to the outside.

Further, in order to ensure the complete sealing by crimping further, annular ring members 23, 24 are interposed between the metal shell 3 and the insulator 2 at the rear end side of the metal shell 3, and powder of talc 25 is loaded between the ring members 23, 24. Namely, the metal shell 3 holds the insulator 2 via the plate packing 22, the ring members 23, 24 and the talc 25.

In addition, a ground electrode 27 is joined to a front end portion 26 of the metal shell 3. The ground electrode 27 is bent halfway along the length thereof so that a side surface at a distal end side thereof faces oppositely a front end portion of the center electrode 5 when the ground electrode 27 is so joined to the metal shell 3. Then, a spark discharging gap 28 is defined between the front end portion of the center electrode 5 and the distal end portion of the ground electrode 27, so that a spark discharge is brought about in this spark discharging gap 28 in a direction which follows the axial line CL1.

Figure 3:
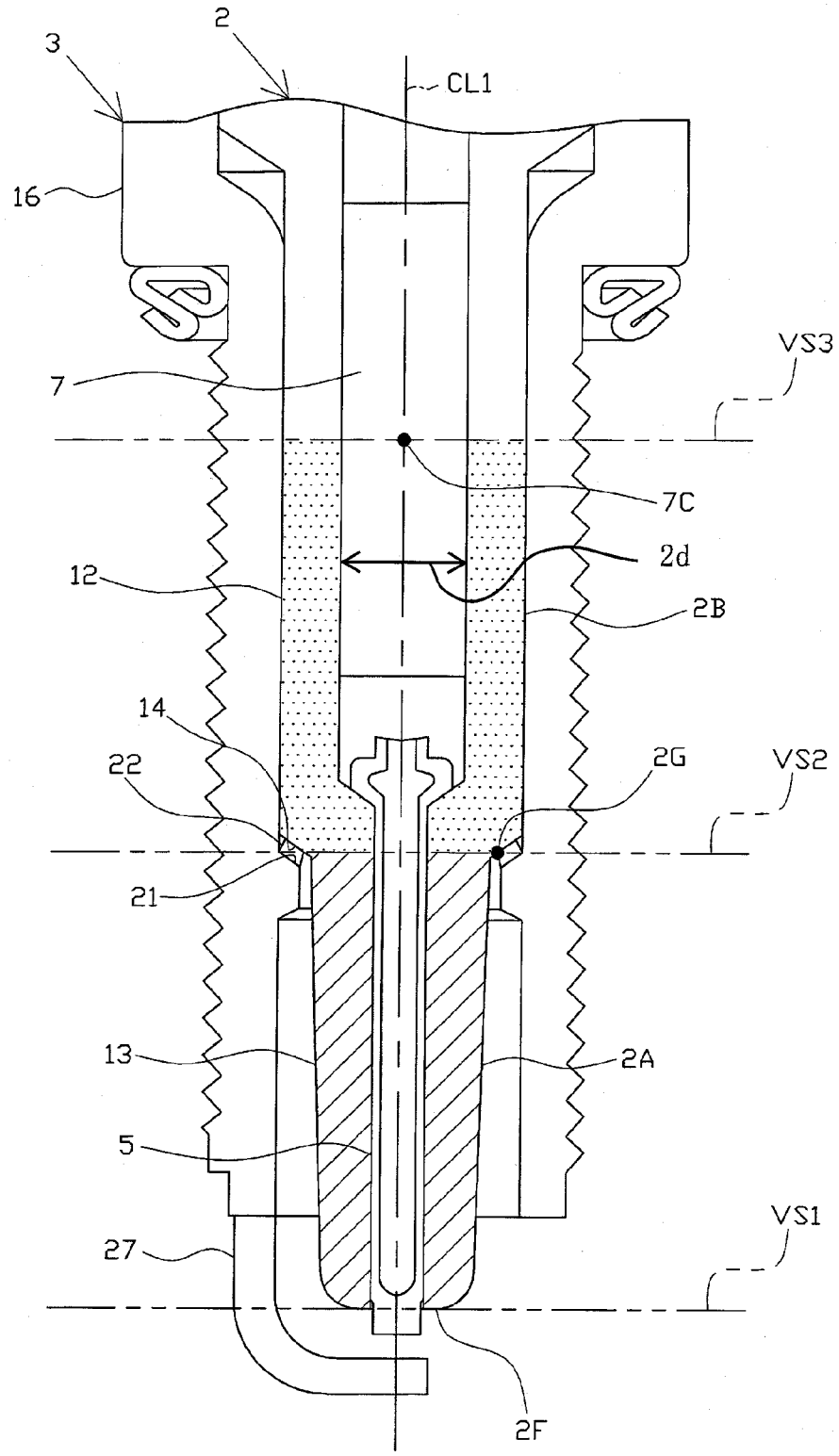
FIG. 3 is an enlarged sectional view of the insulator, etc.

Next, the configuration of the insulator 2, which constitutes a characteristic part of the invention, will be described. In this embodiment, as shown in FIG. 3 (in FIG. 3, as a matter of convenience, the hatching of the metal shell 3 or the like is omitted), when a relative density of a front end portion 2A, which will be described later, of the insulator 2 is referred to as A (%) and a relative density of a middle portion 2B, which will be described later, of the insulator 2 is referred to as B (%), the insulator 2 is configured so as to satisfy $93.90 \leq A$ and $0.10 \leq A-B \leq 0.90$ (or more preferably, $0.15 \leq A-B \leq 0.50$). Namely, the relative density B of the middle portion 2B is made smaller by 0.10% or larger and 0.90% or smaller than the relative density A of the front end portion 2A, so that the thermal conductivity of the middle portion 2B becomes relatively small.

The front end portion 2A constitutes a portion (a portion shaded with oblique lines in FIG. 3) of the insulator 2 which is positioned between a radial virtual plane VS1 including a front end 2F and a radial virtual plane VS2 including a front end 2G of a portion which contacts the plate packing 22, and this portion includes a thinnest portion of the insulator 2. In addition, the middle portion 2B constitutes a portion (a portion shaded with a scattering dot pattern in FIG. 3) which is positioned between the virtual plane VS2 and a radial virtual plane VS3 including a center 7C of the resistor 7 in the direction of the axial line CL1.

Here, the "relative density" means a ratio of an actual density of the insulator 2 to a theoretical density of the insulator 2. The "theoretical density" means a density which is calculated from contents of oxides, which are obtained by expressing the contents of elements contained in the insulator 2 (which can be measured by EPMA, for example) in terms of oxide, based on the mixing rule. The "actual density" means a density which is measured based on the Archimedian method.

Further, for example, in forming the insulator, the relative densities A, B can be made to satisfy the aforesaid relation by controlling the pressure applied to the powder material PM from the rubber mold 42 (by making the pressure applied to the portion corresponding to the front end portion 2A larger than the pressure applied to the portion corresponding to the middle portion 2B). In addition, the relative densities A, B can be made to satisfy the aforesaid relation by controlling the thickness of the rubber mold 42 (by making the thickness of a portion of the rubber mold 42 which applies the pressure to the portion corresponding to the front end portion 2A smaller than the thickness of a portion of the rubber mold 42 which applies the pressure to the portion corresponding to the middle portion 2B) or by controlling the hardness of the rubber mold 42 (by making the hardness of the portion of the rubber mold 42 which applies the pressure to the portion corresponding to the front end portion 2A larger than the hardness of the portion of the rubber mold 42 which applies the pressure to the portion corresponding to the middle portion 2B).

Thus, as has been described above, according to the embodiment, the relative density of the front end portion 2A of the insulator 2 is 93.90% or larger. Consequently, it is possible to prevent the generation of through discharge more reliably.

Further, the relative density B (%) of the middle portion 2B is configured so as to satisfy $0.10 \leq A-B$. Consequently, the thermal conductivity at the middle portion 2B can be made relatively small, whereby it is possible to make it difficult for heat received by the front end portion 2A to be conducted to the resistor 7. As a result, the increase in resistance value of the resistor 7 can be suppressed, thereby making it possible to extend the life of the resistor 7.

In addition, in the embodiment, the insulator 2 is configured so that $A-B \leq 0.90$ is satisfied, and therefore, it is possible to prevent the concentration of stress to a boundary portion between the front end portion 2A and the middle portion 2B more reliably. As a result, it is possible to realize superior mechanical strength in the insulator 2.

Figure 4:
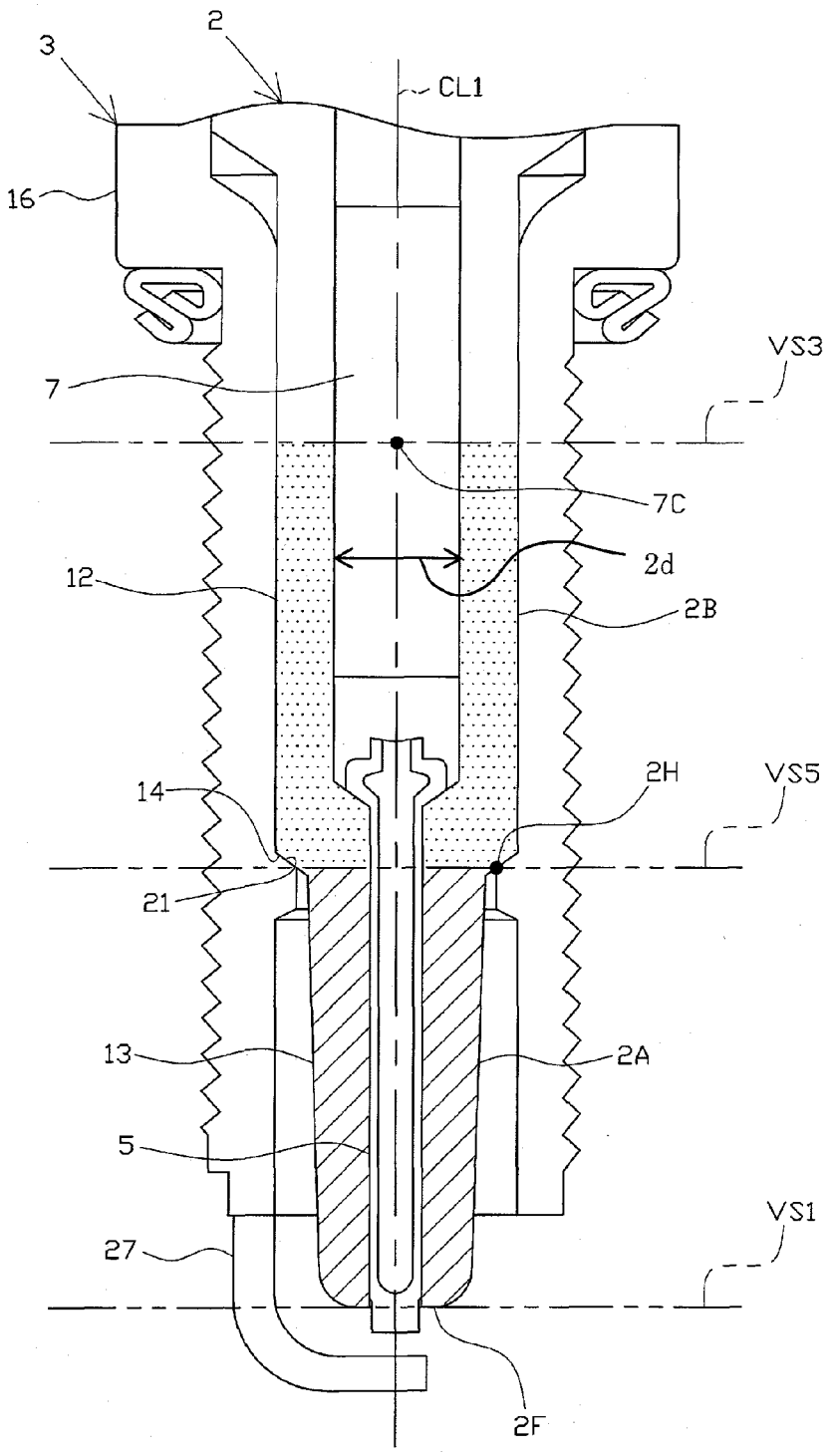
FIG. 4 is an enlarged sectional view of an insulator, etc., according to a different embodiment.

Furthermore, in the axial hole 4 of the insulator 2, the resistance value of the resistor 7 tends to increase easily in a configuration where a diameter of the portion of the insulator 2 where the resistor 7 is disposed satisfies a value of 2.9 mm or smaller. In this respect, it is effective to suppress the increase in resistance value by adopting the first aspect and the second aspect. In FIGS. 3 and 4, in the axial hole 4 of the insulator 2, the diameter of the portion of the insulator 2 where the resistor 7 is disposed is denoted by 2*d*.

Next, a withstand voltage evaluation test and a resistor durability evaluation test were carried out on samples of ignition plugs in which the relative density A (%) of front end portions and the relative density B (%) of middle portions of insulators were changed variously with a view to verifying the working effect provided by the embodiment. Additionally, a bending strength evaluation test was carried out on samples of insulators in which the relative densities A, B were changed variously.

The withstand voltage evaluation test is summarized as follows. Namely, 50 samples having the same relative density A and the same relative density B were prepared, respectively, and were than mounted in a predetermined engine. Then, a voltage of 40 kV was applied to the samples (spark discharging gaps). Then, in the 50 samples, the number of samples in which a through discharge was generated which penetrated the front end portion of the insulator was counted to calculate a generation rate of through discharge (a penetration occurrence rate). Here, the samples in which the penetration occurrence rate was less than 5% are evaluated as having an extremely superior withstand voltage performance, and are indicated by "◉". The samples in which the penetration occurrence rate was 5% or larger and less than 15% are evaluated as having a good withstand voltage performance, and are indicated by "○". On the other hand, the samples in which the penetration occurrence rate was 15% or larger and less than 25% are evaluated as having a slightly inferior withstand voltage performance, and are indicated by "Δ". The samples in which the penetration occurrence rate was 25% or larger are evaluated as having an inferior withstand voltage performance and, are indicated by "×".

In addition, the resistor durability evaluation test is summarized as follows. Namely, 10 samples having the same relative density A and the same relative density B were prepared, respectively, and were than mounted in motor vehicle transistor ignition devices. Then, front end portions of the samples were heated to 400° C., and a discharging voltage of 30 kV was applied to the samples so as to generate 3600 spark discharges per minute. In each sample, a length of time during which a resistance value at normal temperatures doubled a resistance value at normal temperatures before test (a doubling time) was measured, and an average of the doubling times of the 10 samples (an average doubling time) was calculated. Here, the samples in which the average doubling time exceeded 100 hours are evaluated as being able to suppress the increase in resistance value of the resistor very effectively, and are indicated by "◉". The samples in which the average doubling time exceeded 50 hours but was 100 hours or shorter are evaluated as having a good resistor value increase suppression effect, and are indicated by "○". On the other hand, the samples in which the average doubling time exceeded 10 hours but was 30 hours or shorter are evaluated as having a tendency that the resistance value is increased slightly easily, and are indicated by "Δ". The samples in which the average doubling time was 10 hours or shorter are evaluated as having a tendency that the resistance value is increased easily, and are indicated by "×".

Further, the bending strength evaluation test is summarized as follows. Namely, 50 samples having the same relative density A and the same relative density B were prepared and were fixed by supporting them at a portion extending from a large-diameter portion to a step portion. Then, a load of 5.5 N·m was applied to a frontmost end portion of each sample along a direction which intersected the axial line at right angles. Then, in the 50 samples, the number of samples in which a breakage was brought about was counted to calculate a generation rate of breakage (a breakage occurrence rate). Here, the samples in which the breakage occurrence rate was less than 5% are evaluated as having an extremely superior mechanical strength and, are indicated by "◉". The samples in which the breakage rate was 5% or larger and smaller than 10% are evaluated as having a good mechanical strength, and are indicated by "○". On the other hand, the samples in which the breakage occurrence rate was 10% or larger and smaller than 20% are evaluated as having a slightly inferior mechanical strength, and are indicated by "Δ". The samples in which the breakage rate was 20% or larger are evaluated as having an inferior mechanical strength, and are indicated by "×".

Table 1 shows the results of the tests. Samples 1 to 8 in Table 1 are samples which do not satisfy the requirements of the first aspect (claim 1), and samples 11 to 27 are samples which satisfy the requirements of the first aspect 1 (claim 1).

TABLE 1

| | Relative Density (%) | | Diameter 2d of Portion of Axial Hole in Insulator where | | Withstand Voltage | Resistor Durability | Bending |
|---|---|---|---|---|---|---|---|
| | Portion A | Portion B | Resistor is Disposed (mm) | A − B (%) | Performance Evaluation | Performance Evaluation | Strength Evaluation |
| Sample 1 | 93.25 | 93.22 | ϕ2.4 | 0.03 | Δ | X | Δ |
| Sample 2 | 93.25 | 93.22 | ϕ2.9 | 0.03 | Δ | X | Δ |
| Sample 3 | 93.25 | 93.22 | ϕ3.9 | 0.03 | X | ○ | X |
| Sample 4 | 93.88 | 93.76 | ϕ3.9 | 0.12 | X | ○ | ○ |
| Sample 5 | 95.12 | 95.10 | ϕ3.9 | 0.02 | ○ | X | ○ |
| Sample 6 | 96.75 | 96.74 | ϕ3.9 | 0.01 | ◉ | X | ◉ |
| Sample 7 | 95.42 | 95.33 | ϕ3.9 | 0.09 | ○ | X | ○ |
| Sample 8 | 96.79 | 95.88 | ϕ3.9 | 0.91 | ◉ | ◉ | X |
| Sample 11 | 93.90 | 93.79 | ϕ2.4 | 0.11 | ○ | ○ | ○ |
| Sample 12 | 93.90 | 93.79 | ϕ2.9 | 0.11 | ○ | ○ | ○ |
| Sample 13 | 93.90 | 93.79 | ϕ3.9 | 0.11 | ○ | ○ | ○ |
| Sample 14 | 94.32 | 94.20 | ϕ3.9 | 0.12 | ○ | ○ | ○ |
| Sample 15 | 95.45 | 95.35 | ϕ3.9 | 0.10 | ○ | ○ | ○ |
| Sample 16 | 96.46 | 96.33 | ϕ3.9 | 0.13 | ◉ | ○ | ◉ |
| Sample 17 | 96.83 | 96.69 | ϕ3.9 | 0.14 | ◉ | ○ | ◉ |
| Sample 18 | 96.84 | 96.69 | ϕ2.4 | 0.15 | ◉ | ◉ | ◉ |
| Sample 19 | 96.84 | 96.69 | ϕ2.9 | 0.15 | ◉ | ◉ | ◉ |
| Sample 20 | 96.84 | 96.69 | ϕ3.9 | 0.15 | ◉ | ◉ | ◉ |
| Sample 21 | 96.83 | 96.33 | ϕ2.4 | 0.50 | ◉ | ◉ | ◉ |
| Sample 22 | 96.83 | 96.33 | ϕ2.9 | 0.50 | ◉ | ◉ | ◉ |
| Sample 23 | 96.83 | 96.33 | ϕ3.9 | 0.50 | ◉ | ◉ | ◉ |
| Sample 24 | 96.83 | 96.32 | ϕ3.9 | 0.51 | ◉ | ◉ | ○ |
| Sample 25 | 96.82 | 95.92 | ϕ2.4 | 0.90 | ◉ | ◉ | ○ |
| Sample 26 | 96.82 | 95.92 | ϕ2.9 | 0.90 | ◉ | ◉ | ○ |
| Sample 27 | 96.82 | 95.92 | ϕ3.9 | 0.90 | ◉ | ◉ | ○ |

As shown in Table 1, it has been found that the samples in which the relative density A is smaller than 93.90% (Samples 1 to 4) are inferior in withstand voltage performance.

On the other hand, it has been confirmed that although the samples in which the relative density A is 93.90% or larger (Samples 5 to 8, 11 to 27) have a good withstand voltage performance, when A-B was smaller than 0.10% (Samples 5 to 7), the resistor values of the resistors tends to be increased easily. It is considered that this is because the middle portion of the insulator has almost the same high thermal conductivity as that of the front end portion whereby heat received by the front end portion tends to be transmitted easily to the resistor by way of the middle portion.

Further, it has been found that the sample in which A-B exceeds 0.90% (Sample 8) is inferior in mechanical strength. It is considered that this is because since the relative densities of the front end portion and the middle portion are too large, stress was concentrated to the boundary portion between the front end portion and the middle portion.

In contrast with this, it has been found clearly that the samples in which the relative density A is 93.90% or larger and A-B is 0.10% or larger and 0.90% or smaller (Samples 11 to 27) exhibit good performances in withstand voltage performance, suppression effect of increase in resistance value of the resistors and mechanical strength.

In addition, it has been verified that the samples in which A-B is 0.15% or larger and 0.50% or smaller (Sample 18 to 23) are extremely superior both in suppression effect of increase in resistance value of the resistor and mechanical strength. Further, it has been found that a very superior withstand voltage performance can be realized by controlling the relative density A to be 96.46% or larger.

It is considered preferable from the results of the tests that the insulator is configured so that the relative density A is 93.90% or larger and A-B satisfies $0.10 \leq A-B \leq 0.90$ in order to ensure good performances all in withstand voltage performance, suppression effect of increase in resistor value of the resistor and mechanical strength.

In addition, from the viewpoint of realizing a further improvement in suppression effect of increase in resistance value of the resistor and mechanical strength, it is preferable that the insulator is configured so that A−B satisfies $0.15 \leq A-B \leq 0.50$.

Additionally, it is preferable that the relative density A is 96.46% or larger in order to improve further the withstand voltage performance.

Further, the resistance value of the resistor tends to increase easily in the configuration in which the diameter of the portion of the axial hole in the insulator where the resistor is disposed satisfies the value of 2.9 mm or smaller. In this respect, it is preferable to adopt the first aspect and the second aspect.

It is noted that the invention is not limited to the contents of the embodiment and hence may also be carried out in the following manner. Other application examples and modification examples which will not be described below can also, of course, be adopted.

(a) In the embodiment, while the insulator 2 (the step portion 14) is described as being engaged with the metal shell 3 (the projecting portion 21) via the plate packing 22, as shown in FIG. 4 (where the hatching of the metal shell 3 and the like is omitted as a matter of convenience), the insulator 2 (the step portion 14) may be engaged directly with the metal shell 3 (the projecting portion 21) without providing the plate packing 22. In this case, the front end portion 2A constitutes a portion (a portion shaded with oblique lines in FIG. 4) of the insulator 2 which is positioned between the virtual plane VS1 and a radial virtual plane VS5 including a front end 2H of a portion of the insulator 2 which comes into contact with the metal shell 3. In addition, the middle portion 2B constitutes a portion (a portion shaded with a scattering point pattern in FIG. 4) of the insulator 2 which is positioned between the virtual plane VS5 and the virtual plane VS3.

(b) In the embodiment, while the ignition plug 1 is described as generating a spark discharge in the spark discharging gap 28 to thereby ignite an air-fuel mixture therein, the configuration of the ignition plug to which the technical concept of the invention can be applied is not limited thereto. Consequently, the technical concept of the invention may be applied, for example, to an ignition plug (a plasma jet ignition plug) in which a cavity portion (a space) is provided in a front end portion of an insulator and an air-fuel mixture is ignited by jetting a plasma generated in the cavity portion.

(c) In the embodiment, while the ground electrode 27 is described as being joined to the front end portion 26 of the metal shell 3, the invention can also be applied to a configuration in which a ground electrode is formed by cutting out a portion of a metal shell (or a portion of a front end metal fixture which is welded in advance to the metal shell) (for example, see JP-A-2006-236906).

(d) In the embodiment, while the tool engagement portion 19 is described as being formed into the shape having the hexagonal cross section, the invention is not limited to such a shape. For example, the tool engagement portion may be formed into a Bi-HEX shape (a modified dodecagonal shape) (ISO 22977:2005 (E)).

What is claimed is:

1. An ignition plug comprising:

an insulator having an axial hole which extends in an axial direction;

a center electrode which is inserted in a front end side of the axial hole;

a metal shell which is provided on an outer circumference of the insulator; and a resistor which is disposed in the axial hole at a position further rearwards than the center electrode, wherein the insulator includes a step portion which engages with the metal shell directly or via an annular plate packing, wherein the resistor is positioned further rearwards in the axial direction than the step portion, wherein, when a relative density of a portion of the insulator, which is positioned between a radial virtual plane including a front end of the insulator and a radial virtual plane including a front end of a portion of the insulator which is in contact with the metal shell or the plate packing, is referred to as A (%), and a relative density of a portion of the insulator, which is positioned between the radial virtual plane including the front end of the portion of the insulator which is in contact with the metal shell or the plate packing and a radial virtual plane including a center of the resistor in the axial direction, is referred to as B (%), the following equations are satisfied:

$93.90 \leq A$, and $0.10 \leq A-B \leq 0.90$.

2. The ignition plug according to claim 1, wherein the following equation is satisfied:

$0.15 \leq A-B \leq 0.50$.

3. The ignition plug according to claim 1, wherein, when a relative density of a portion of the insulator, which is positioned between the radial virtual plane including the center of the resistor in the axial direction and a radial virtual plane including a rear end of the insulator, is referred to as C (%), the following equation is satisfied:

$C \leq B$.

4. The ignition plug according to claim 1, wherein a diameter of a portion of the axial hole in which the resistor is disposed is 2.9 mm or smaller.

* * * * *